United States Patent [19]

Barrow et al.

[11] Patent Number: 4,719,385

[45] Date of Patent: Jan. 12, 1988

[54] MULTI-COLORED THIN-FILM ELECTROLUMINESCENT DISPLAY

[76] Inventors: William A. Barrow, 1400 NW. Compton Dr., Beaverton, Oreg. 97006; Richard T. Tuenge, Rte. 2, Box 1018, Hillsboro, Oreg. 97123

[21] Appl. No.: 727,663

[22] Filed: Apr. 26, 1985

[51] Int. Cl.[4] ..... H01J 1/62

[52] U.S. Cl. ..... 313/463; 313/506; 340/781; 358/59

[58] Field of Search ..... 313/463, 506, 582, 585, 313/586, 587; 358/59; 340/781

[56] References Cited

U.S. PATENT DOCUMENTS

| | | | |
|---|---|---|---|
| 2,867,739 | 1/1959 | Michlin | 340/781 X |
| 3,152,222 | 10/1964 | Loebner | 358/59 |
| 3,531,585 | 9/1970 | Strain | 358/59 |
| 3,588,596 | 6/1971 | Tech | 313/585 X |
| 3,716,742 | 2/1973 | Nakayama et al. | 313/587 |
| 3,904,905 | 9/1975 | Watanabe et al. | 313/586 X |
| 4,155,030 | 5/1979 | Chang | 313/463 X |
| 4,396,864 | 8/1983 | Suntola et al. | 313/506 |
| 4,416,933 | 11/1983 | Antson et al. | 313/506 X |

FOREIGN PATENT DOCUMENTS 133584 7/1984 Japan .

*Primary Examiner*—Stewart J. Levy
*Assistant Examiner*—Joseph W. Roskos
*Attorney, Agent, or Firm*—Chernoff, Vilhauer, McClung & Stenzel

[57] ABSTRACT

A novel TFEL structure for providing a reliable, high performance multi-colored matrix-addressable flat screen display. The structure comprises a multi-layered panel consisting of two or more TFEL subpanels stacked one on top of the other, with each subpanel utilizing a light-emitting phosphor of a different color. All the layers in the composite structure (with the possible exceptions of the supporting substrate layer and the electrode and insulating layers located farthest from the viewer) are transparent, and the multi-layered subpanels are supported on respective substrates and connected by spacers to maintain the subpanel components in predetermined close proximity. The intervening space between the component panels is filled with a protective oil to improve the performance and optical characteristics of the device. The oil may also be dyed to serve as a filter modifying the light emission characteristics of the composite display device.

7 Claims, 2 Drawing Figures

MULTI-COLORED THIN-FILM ELECTROLUMINESCENT DISPLAY

GENERAL

The research culminating in this invention was conducted, in part, under contract DAAK20-84-C-0420 with the U.S. Army Electronics Research and Development Command, Fort Monmouth, N.J., pursuant to which contract the Government possesses certain property rights in said invention.

BACKGROUND OF THE INVENTION

This invention relates to thin-film electroluminescent devices (TFEL) and, more particularly, to a TFEL matrix display panel utilizing different color phosphor materials in separate layers to provide a multi-colored display.

AC-driven monochromatic TFEL devices, such as that depicted in Inazaki et al Pat. No. 3,946,371 comprising five layers, namely, a pair of insulating layers sandwiching an electroluminescent phosphor layer, and a pair of electrodes in turn sandwiching the insulating layers, with the entire laminar structure being supported on a substrate of glass or other transparent material, are well known. Such TFEL devices, with associated power supply, matrix addressing and logic circuitry, are utilized as flat screen display monitors for portable computers in military and commercial applications. However, it is desirable, particularly for the purposes of improving the legibility and usefulness of such display devices, to have the information presented in more than one color. At the present time multi-color display capability in computers is provided principally by color CRT devices but it would be desirable, particularly in applications requiring portability and lightweight, that a flat screen display be available with this capability as well.

While full spectrum color display would require three primary color generation capability in a display device, a very useful range and variety of color discrimination is obtainable by the device of the present invention utilizing two different color phosphors.

SUMMARY OF THE INVENTION

This invention is directed to a novel TFEL structure for providing a reliable, high performance multi-colored matrix-addressable flat screen display. In brief, the structure comprises a multi-layered panel consisting of two or more TFEL subpanels stacked one on top of the other, with each subpanel utilizing a lightemitting phosphor of a different color. All the layers in the composite structure (with the possible exceptions of the supporting substrate layer, electrode layer and insulating layer located farthest from the viewer) are transparent, and the multi-layered subpanels are supported on respective substrates and connected by spacers to maintain the subpanel components in predetermined close proximity. If desired the intervening space between the component panels may be filled with a protective oil to improve the performance and optical characteristics of the device and, if desired or necessary, the oil may also be dyed to serve as a filter modifying the light emission characteristics of the composite display device.

It is therefore a principal objective of the present invention to provide a TFEL device capable of displaying a plurality of colors.

It is another important object of the present invention to provide a multi-colored TFEL device for use in flat screen monitors.

And it is still a further objective of the present invention to provide an improved TFEL device providing a high reliability multi-colored display.

The foregoing and other objectives, features and advantages of the present invention will be more readily understood upon consideration of the following detailed description of the invention taken in conjunction with the accompanying drawings.

DETAILED DESCRIPTION OF THE INVENTION

Figure 1:
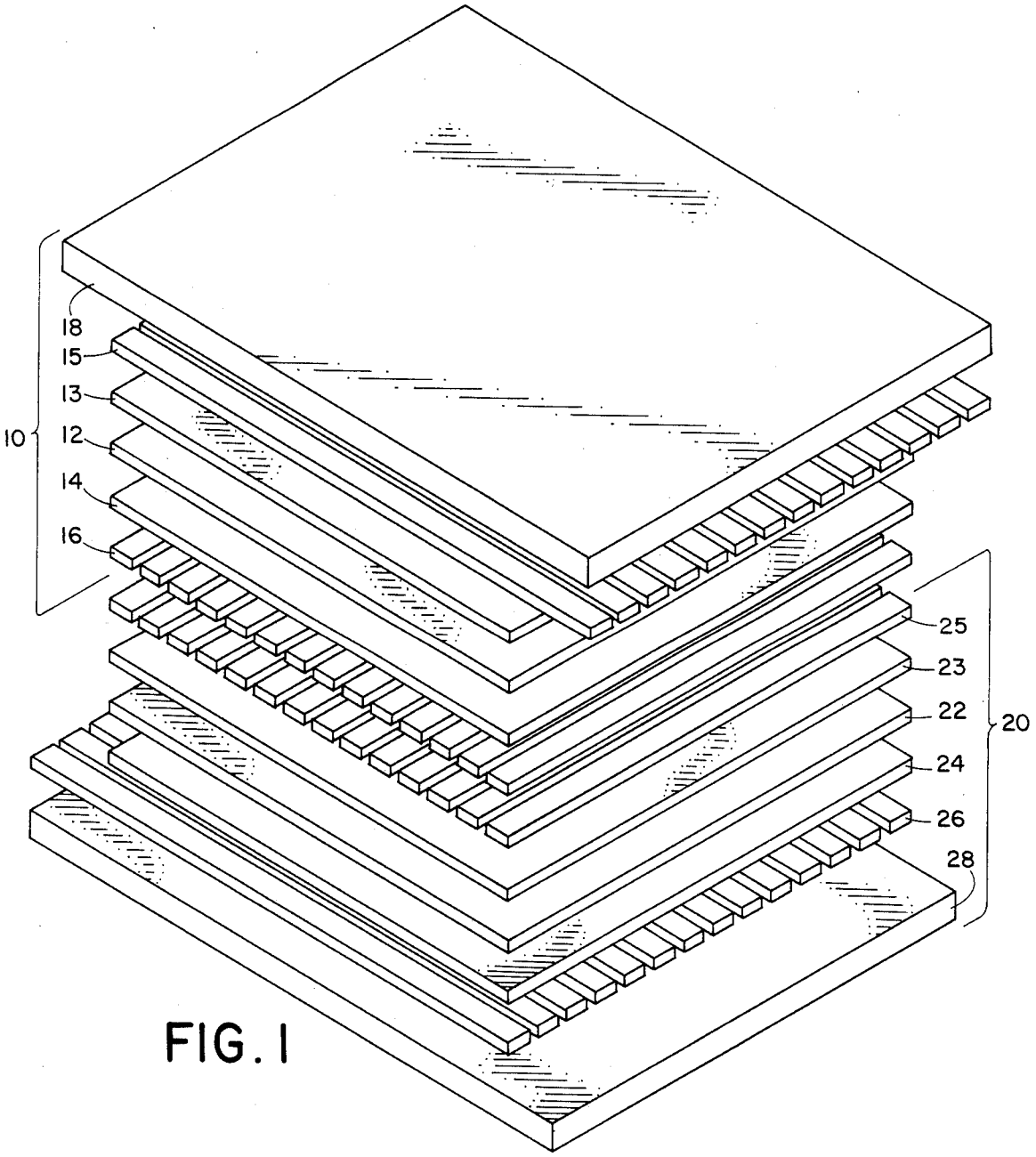
FIG. 1 is an exploded perspective view of a multi-layered TFEL device utilizing two different color phosphors to obtain a multi-colored display in accordance with the principles of the present invention.

Referring to the Figures, a two-color phosphor TFEL matrix structure, capable of providing a multi-colored display through a combination of selective energization of portions of the component TFEL subpanels therein and selective differentiation of the emission intensity levels thereof, is depicted. (In understanding this structure it will simplify matters to consider it as being composed of two single color phosphor multilayered TFEL devices arranged face-to-face, that is, congruently, one on top of the other.) The first device or component subpanel 10, containing a first color phosphor, is depicted in the upper position, and the second component subpanel 20, containing the second color phosphor, is on the bottom. Considering the upper subpanel, which is also representative of the bottom one, it is of conventional configuration for a TFEL device, comprised of a central layer 12 containing an electroluminescent phosphor, a pair of insulating layers 13, 14 sandwiching the phosphor layer, a pair of electrodes 15, 16 in a matrix array which in turn sandwich the insulating layers and the intermediate phosphor layer. The electrode layers 15, 16, in order to maximize transparency, conductivity and reliability, are formed of thin gold film with a thickness of 80 to 120 angstroms. Alternatively, but with less satisfactory results, thin aluminum, other thin metal films or indium tin oxide could be employed. The laminar structure just described is supported on a substrate 18 of glass or other transparent material, with the panel being driven in conventional fashion by an AC source (not shown) providing selective illumination of selective portions of the panel through the use of matrix-addressing logic circuitry (not shown).

Figure 2:
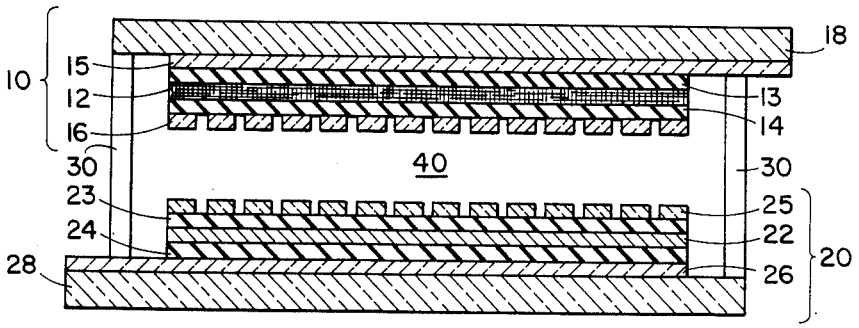
FIG. 2 is a sectional view of the TFEL device depicted in FIG. 1, in unexploded form, showing the provision of spacers to maintain the component subpanels in predetermined spaced arrangement and the cavity therebetween filled with oil.

The component subpanel 20 is similarly comprised of an intermediate phosphor layer 22, sandwiching insulating layers 23, 24, a sandwiching pair of transparent electrodes 25, 26, and a supporting substrate 28, the subpanel being driven separately by its own associated logic switching circuitry (not shown). The two subpanels 10, 20 are arranged congruently, one on top of the other, and maintained in close predetermined proximity by separating spacers 30 in the form of a plurality of posts, shown in FIG. 2 but omitted from FIG. 1 for the purposes of clarity, distributed about the periphery of the structure. In accordance with conventional practice the entire structure is sealed hermetically, with the interior cavity 40 formed between the two opposing component layers 10, 20 being filled with a protective oil such as silicone oil prior to sealing the structure. The protective oil serves the conventional function of maintaining the dielectric integrity of the TFEL device by filling in pinholes and preventing premature electrical breakdown of the structure. The protective oil function and sealing technique are well described in Inohara et al U.S. Pat. No. 4,357,557. In addition, the oil may be dyed if desired to act as a filter to alter the transmitted light characteristics of the phosphor used in the subpanel farthest from the viewer. It has been found that the oil improves the optical coupling of the two subpanels by reducing light scattering.

The composite structure serves to provide, through the provision of two separately-driven, different phosphor color, matrix subpanels 10, 20, a multicolor color display when the structure is viewed from either planar surface. In some applications, only one side of the panels, referred to as the front, is used for viewing purposes and the other, the backside, is mated with a printed circuitboard containing driver electronics for selective energization of the respective matrix arrays. Accordingly, the substrate on the backside as well as the farthermost electrode and insulating layers need not be transparent but could be of opaque material.

Because, with the possible exceptions of the supporting substrate on the backside and the farthest electrode and insulating layers, all of the layers of the multi-layered laminate forming the composite panel structure are transparent (i.e., the intermediate phosphor layers, at least the three nearmost to the frontside electrode and insulating layers, the front side substrate, as well as the filler oil), illumination of the phosphors in the respective layers produces a multi-color display. Mixing the levels of intensity of the respective phosphors which are illuminated at a particular matrix address (i.e., screen location) will produce different colors over the range of the visible spectrum, within the limits achievable by mixing two colors. For example, one of the phosphors may be a yellow phosphor of zinc sulphide host material doped with manganese (ZnS:Mn), and the second layer may be a blue phosphor composed of strontium sulphide doped with cerium fluoride ($SrS:CeF_3$). The oil filling the cavity 40 could be dyed, for example, with red coloring, such as red dye No. 19 which readily dissolves in silicone oil, to serve as a filter. Thus, when the display is viewed with the blue light phosphor subpanel close to the viewer and the yellow layer farthest, and an intermediate red dye oil filter, color mixtures ranging in spectrum from blue to red can be obtained. In similar fashion, through the use of other oil dye colors or other color phosphors in the respective layers, different light spectrum variations can be accomplished by selective illumination of the respective component subpanels.

While the invention has been described and depicted utilizing but two color phosphor subpanel components, by making all the intermediate layers and substrates transparent, additional component subpanels containing other color phosphors can be stacked onto the structure. For example, a composite structure formed of three component subpanels each containing a primary color phosphor would enable the full range of colors to be produced in a display through selective regulation of the intensity of illumination of the respective phosphors at the matrix intersections of the respective subpanels. (However, as additional subpanels are added parallax considerations in viewing the display come into play.) Also, instead of arranging the two component subpanels face-to-face they could if desired be aligned one on top of the other facing in the same direction, although this latter arrangement would decrease the intensity of the resultant display produced by the panel farthest from the viewer because of the interposition of an additional covering layer, and would also reduce the useful viewing angle of the resultant display because of parallax. For that reason it may not be a desirable arrangement.

The terms and expressions which have been employed in the foregoing specification are used therein as terms of description and not of limitation, and there is no intention of the use of such terms and expressions of excluding equivalents of the features shown and described or portions thereof, it being recognized that the scope of the invention is defined and limited only by the claims which follow.

What is claimed is:

1. A multi-colored thin-film electroluminescent (TFEL) device comprising:

(a) a first independently addressable TFEL matrix array comprising a light-emitting phosphor of a first color sandwiched between a first set of electrodes, said electrodes comprising orthogonally disposed front and rear electrode groups;

(b) a second independently addressable TFEL matrix array comprising a light-emitting phosphor of a second color, said second color differing from said first color, sandwiched between a second set of electrodes, said electrodes comprising orthogonally disposed front and rear electrode groups; and (c) spacer means for maintaining said first and second matrix arrays in uniform, closely spaced apart relation wherein both matrix arrays are congruent with one another.

2. The TFEL device of claim 1 wherein said first and second matrix arrays are formed of transparent gold electrodes, each electrode having a thickness in the range of 80–120 angstroms.

3. The TFEL device of claim 2 wherein the spacing between the first and second matrix arrays is filled with a protective oil and the composite structure is hermetically sealed.

4. The TFEL device of claim 3 wherein said oil has a coloring dye dissolved therein for alterning the characteristics of light transmitted therethrough.

5. The TFEL device of claim 4 wherein said red dye is red dye number 19.

6. The TFEL device of claim 1 wherein both light-emitting phosphors are selected from the color group consisting of blue, red, green and yellow.

7. The TFEL device of claim 1 wherein said light-phosphor of said first color is comprised of $SrS: CeF_3$, and said light-emitting phosphor of said second color is comprised of ZnS: Mn.

* * * * *

UNITED STATES PATENT AND TRADEMARK OFFICE

CERTIFICATE OF CORRECTION

PATENT NO. : 4,719,385

DATED : January 12, 1988

INVENTOR(S) : William A. Barrow

It is certified that error appears in the above-identified patent and that said Letters Patent is hereby corrected as shown below:

| | |
|---|---|
| Col. 1, line 52 | Change "lightemitting" to --light-emitting-- |
| Col. 3, line 20 | After "multicolor" delete --color-- |
| Col. 4, line 53 | Change "alterning" to --altering-- |

Signed and Sealed this

Fifteenth Day of November, 1988

*Attest:*

*Attesting Officer*

DONALD J. QUIGG

*Commissioner of Patents and Trademarks*